US005224611A

United States Patent [19]

Phillipson et al.

[11] Patent Number: 5,224,611

[45] Date of Patent: Jul. 6, 1993

[54] SYSTEM FOR STORING AND DISPLAYING MERCHANDISE

[75] Inventors: Brian Phillipson, Longwood, Fla.; Roger Pinnick, Columbus, Ohio; Marla K. Aberegg, Newark, Ohio; Martin J. Beck, Powell, Ohio; Ronald Homitz, Pittsburgh, Pa.

[73] Assignee: The Gale Group, Inc., Orlando, Fla.

[21] Appl. No.: 822,965

[22] Filed: Jan. 16, 1992

[51] Int. Cl.[5] ..... A47F 7/00

[52] U.S. Cl. ..... 211/168; 211/126

[58] Field of Search ..... 211/168, 169, 126, 47, 211/48, 81, 45, 44, 150

[56] References Cited

U.S. PATENT DOCUMENTS 3,655,065 4/1972 Vellia ..... 211/194
3,760,952 9/1973 White ..... 211/168
3,856,147 12/1974 Piretti ..... 211/188
5,072,838 12/1991 Price et al. ..... 211/162

*Primary Examiner*—Robert W. Gibson, Jr.
*Attorney, Agent, or Firm*—Allen, Dyer, Doppelt, Franjola & Milbrath

[57] ABSTRACT

A system for storing and display different types of merchandise items. The system includes a plurality of juxtaposed modules having a side wall and a plurality of shelves for holding the merchandise items. The items are stored on the shelves in boxes which slide through an opening on the front of shelves. The modules pivot about an axis to permit the boxes to easily be removed. Removable panels slidably attach to the front wall to support and display the merchandise item stored on an adjacent shelf. At least one of the modules allow items to be inserted into the module through an opening on the module's front as well as through an opening on a module's front side.

22 Claims, 2 Drawing Sheets

SYSTEM FOR STORING AND DISPLAYING MERCHANDISE

BACKGROUND OF THE INVENTION

This invention relates to a method and apparatus for storing and displaying merchandise, and more particularly, relates to a merchandise display rack that holds merchandise items on shelves while displaying the items on the shelf.

Many different types of display racks have been used to display merchandise items in stores. Typically, these display racks include vertically spaced, horizontally oriented shelves forming storage bins for holding and storing such merchandise items. Below or beside these shelves are vertical display panels which show a sample of the item stored on the shelf. Other display racks such as those shown in U.S. Design Pat. No. Des. 296,280 are racks that hold books, tapes and records but do not provide panels for displaying items on those racks.

A drawback to conventional racks is that when both storing and displaying the merchandise on one rack, a great deal of floor space is used up by the rack. In department stores and showrooms, floor space is at a premium. Consequently, the display space is not often provided to indicate what is on an adjacent shelf. Thus, the customer is forced to rummage through bins to find the desired merchandise item.

Another drawback to convention display racks is that when the merchandise items are changed with new inventory, the rack positioning and the subsequent display panels must be changed. As the display and the shelf are often located in different places on the rack, this is time consuming. Further, the store clerk may misplace the items on the shelf with the items being displayed. Misplacement of items causes confusion to the customer.

Another problem with convention display racks is that the size of the merchandise item being stored may change with new inventory. Consequently, the distance between the shelves must be changed as well as the position of the display. Often, due to the general rack and display, the position of the shelves and the display panels cannot often be changed. This forces the store clerk to place fewer items on the shelf forcing the clerk to constantly replenish items in the storage bin as they are sold.

Finally, when the merchandise items must be replenished, the positioning of the display creates difficulties in removing items from the bins. Thus, when the shelves are replenished, the clerk must spend a great deal of time moving the shelves around to re-stock the storage bins.

SUMMARY OF THE INVENTION

In a preferred embodiment of the invention a plurality of juxtaposed modules, each having vertically oriented and opposingly facing front and back side walls, support horizontally oriented shelves. The side walls have an opening therebetween at one end and the shelves are vertically stacked between the side walls to form compartments between adjacent shelves with the inner surface of the side walls. The shelves are offered to support merchandise items received through an opening between the walls. The front walls have an outer surface with means for supporting a merchandise sample of one of the merchandise items horizontally adjacent with one of the shelves where at least one of the sample merchandise items has the merchandise item that is to be stored. The modules are constructed with the front side wall that functions as both a display and a wall that holds the merchandise items being stored. The wall serves a dual purpose. First to save floor space and second to hold the shelves. The samples are stored next to the shelves of the particular merchandise items that are to be stored, thus the shelf configuration and sample configuration may be easily moved and changed when new items replace the old items. When the shelves are replenished, the modules rotate about a vertical axis allowing boxes to be stored on the shelves that can be easily slid in and slid out.

In another preferred embodiment, a method for storing and displaying different types of merchandise items is disclosed. The method comprises the steps of juxtaposing a plurality of modules with vertically oriented and opposingly facing front and back side walls. The horizontally oriented shelves are supported with the inner surface of the walls. The shelves are stacked between the side walls to form a compartment with the modules. An opening is provided at one end of the front back side wall. Merchandise items are placed through the opening and onto the shelves such that each of the compartments contain the same type of merchandise item. A sample of each merchandise item is supported on an outer surface of the front side wall at a location horizontally adjacent one of the compartments where the same type of item is placed. By using the front side wall as a means for supporting merchandise items, as well as the wall of the compartment where the merchandise items are stored, floor space is saved without reducing the display area.

D

DESCRIPTION OF THE PREFERRED EMBODIMENTS

Figure 1:
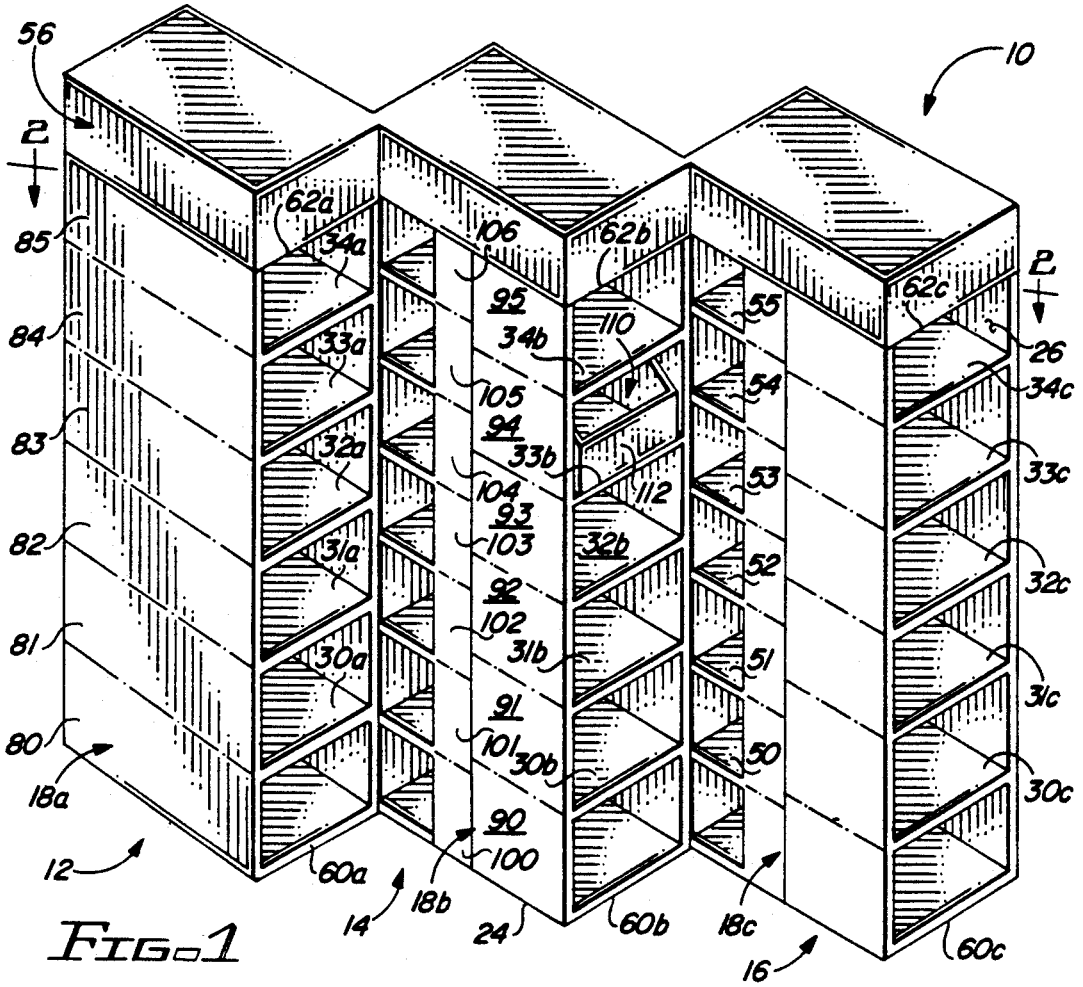
FIG. 1 is a perspective view of the storage and display system embodying the present invention.
Figure 2:
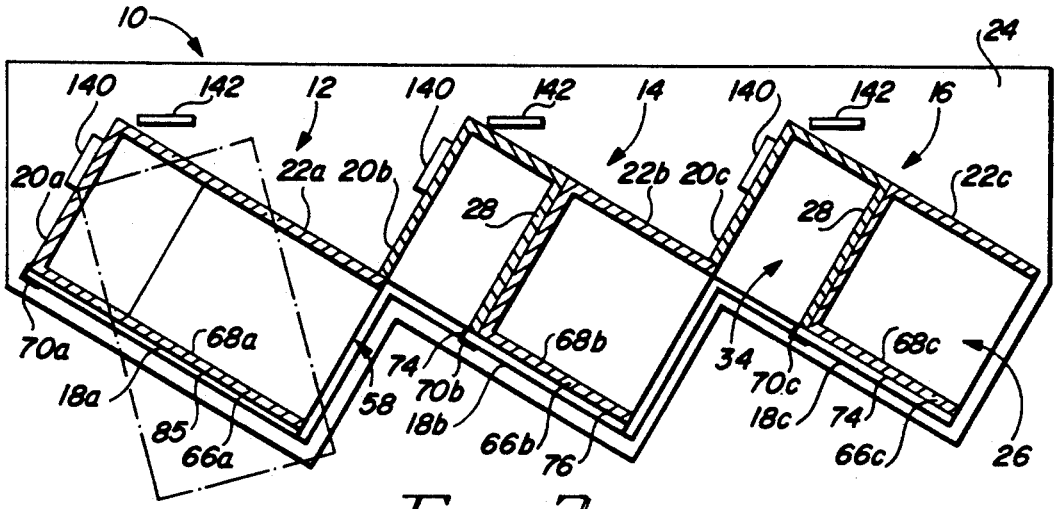
FIG. 2 is a top sectioned view of the storage and display system cut along line 2—2 of FIG. 1.

Referring to FIGS. 1 and 2, there is shown a storage and display system 10 having juxtaposed main module 12, intermediate module 14 and intermediate module 16. Each of the modules 12–16 have a front side wall 18(*a–c*), rear wall 20(*a–c*) (FIG. 2) and a back side wall 22(*a–c*). Referring to FIG. 2, front side wall 18(*a–c*) and back side wall 22(*a–c*) support a plurality of shelves 30*a*–34*a*, 30*b*–34*b* and 30*c*–34*c* on each of modules 12, 14 and 16 respectively. Modules 12–16 and the compartments used to form modules 12–16 are made of conventional materials, such as particle board, plastic, veneer, cardboard or other materials that provide structural support.

Figure 3:
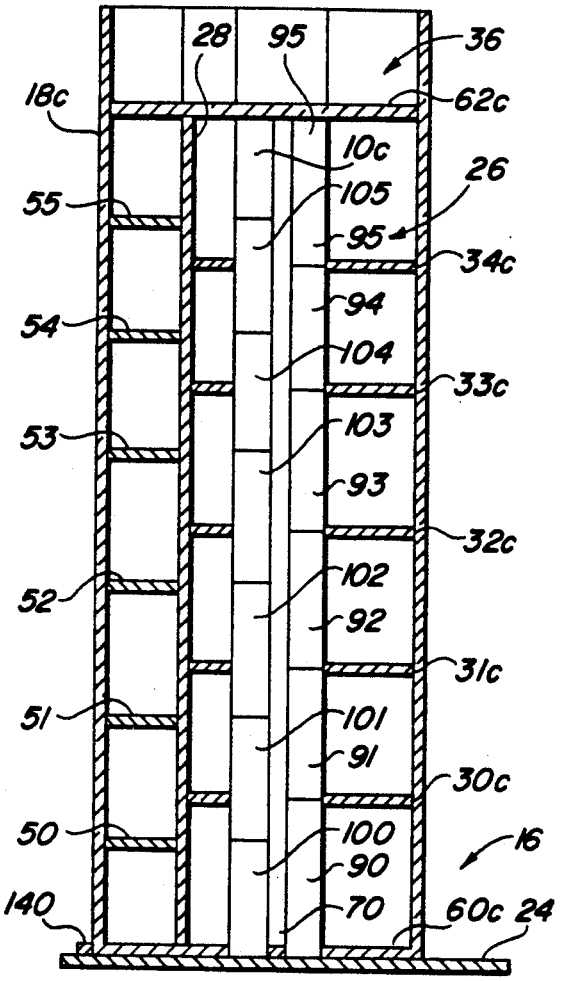
FIG. 3 is a side sectioned view of the storage and display system cut along line 3—3 of FIG. 2.

Intermediate modules 14 and 16 are identical in all aspects and accordingly a description will only be provided of intermediate module 16. Referring to FIGS. 1–3, intermediate module 16 front side wall 18*c* opposingly faces back side wall 22*c* and extends vertically above base 24. Module 16 has an opening 26 along a side facing rear wall 20*c*. Referring to FIG. 2, front side wall 18c extends substantially along one side of module 16 and terminates into a connecting wall 28 that extends perpendicularly from front wall side wall 18c to back side wall 22c. Connecting wall 28 partitions module 14 into two chambers 40 and 42. Chamber 40 is encircled on its sides by opening 36, connecting wall 28, a portion of back side wall 22c and rear wall 20. Referring to FIGS. 1 and 3, vertically stacked within chamber 42 are shelves 30c-34c, and vertically stacked within chamber 40 are horizontally oriented shelves 50-55. Shelves and walls in each of modules 12-16 combine to form a plurality of individual compartments or bins that are adapted to hold merchandise items.

Extending perpendicularly in module 12 between one end of front side wall 18a and one end of back side wall 22a is rear wall 20a. At the other end of side walls 18a and 22a from rear wall 20a is opening 57. Openings 57 and 26 face the same direction when modules 12-16 are oriented in their normal display position.

Referring to FIGS. 1 and 3, modules 12-16 have a floor 60(a-c) respectively at the bottom of modules 12-16 and have a top 62(a-c) on the upper part of modules 12-16. Resting on top 62(a-c) of modules 12-16 is a box 56 forming an upper display assembly.

Referring to FIG. 2, front side walls 18(a-c) have a planar outer surface 66(a-c) and a planar inner surface 68(a-c). Disposed on the edges of front side walls 18(a-c) are outer track guides 70(a-c) and 72(a-c) which extend from top 62 to floor 60 in each of the modules 12-16. Intermediate modules 14 and 16 have a dividing track guide 74 which is disposed on outer surfaces 66b and 66c between outer track guides 70(b-c) and 72(b-c). Referring to FIGS. 1-2, disposed between outer track guides 70a and 72a on module 12 are display panels 80-85. Each of the display panels slide between outer guides 70a and 72a and are positioned adjacent a compartment in module 12.

Between one of the outer track guides 72(b-c) and dividing track guide 74 on modules 14 and 16 are display panels 90-95. Each panel 90-95 slides in between the track guides 72(b-c) and 74 and is positioned adjacent a compartment in chamber 42. Display panels 100-106 slide onto the surface 66c of modules 14 and 16 between track guide 74 and track guide 70(b-c). When panels 100-106 are slid into place, they are positioned adjacent a compartment in chamber 40.

Display panels 80-85, 90-95 and 100-106 preferably hold a sample of the merchandise item that is to be placed in the compartment horizontally adjacent the display panel that holds the sample. The display panels 80-85, 90-95 and 100-106, in conjunction with front side walls 18(a-c), support the sample of the merchandise item using brackets, clamps or other conventional means. Although five-six shelves with display panels are shown adjacent each of the compartments on the modules 12 and 14, the number of shelves and panels can be changed, and the position of the shelves can be adjusted to accommodate various sizes of merchandise items.

Referring to FIG. 1, disposed within each of the compartments are boxes 110 having walls that extend along the side of the compartments. Boxes 110 hold merchandise items and preferably have a display panel 112 that is visible through openings 26, 34 or 57. Boxes 110 have a partial opening 114 above panel 112 to allow merchandise items to be easily placed into and removed from compartments.

Figure 4:
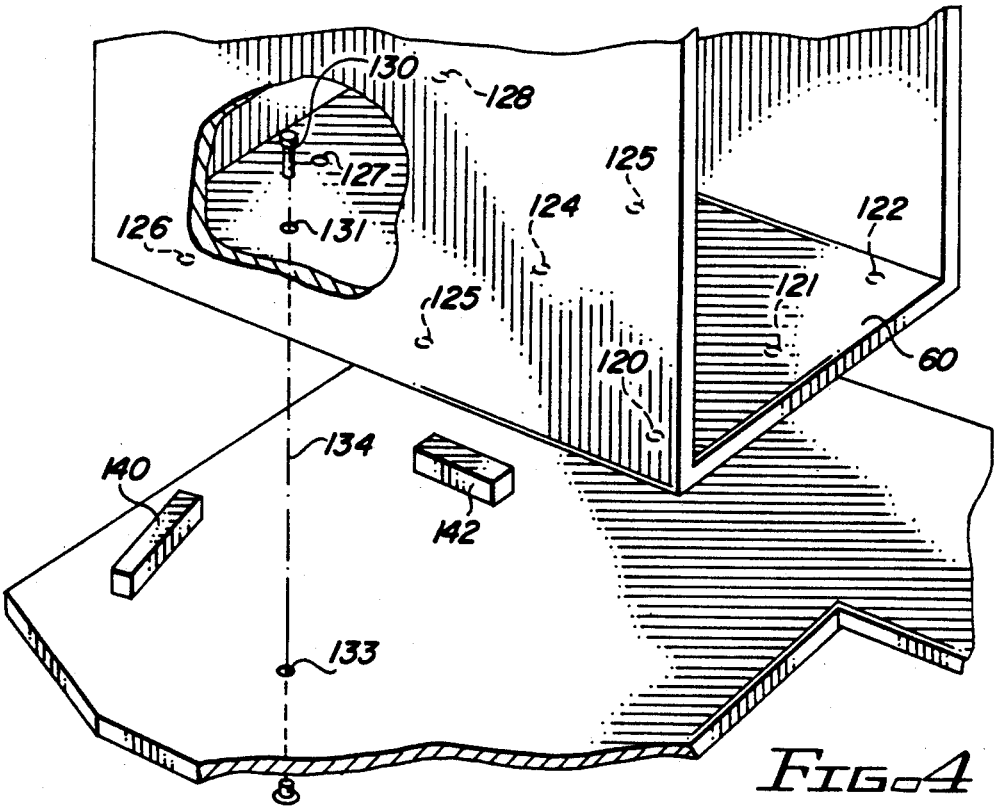
FIG. 4 is a bottom plan view of the main module in the storage and display system shown in FIGS. 1 and 2.

Referring to FIG. 4, disposed on the bottom of floor 60(a-c) of modules 12-16 are frictionless feet 120-128. Also pivot 130 is inserted through an aperture 131 in the center of one quadrant of the floor 60(a-c) of each of the modules 12-16. Pivot 130, once inserted through aperture 131 is fed through a second aperture 133 on base 24, pivot 130 is held in place with a propel nut 132 on the bottom of base 24. Pivot 130, in conjunction with frictionless feet 120, allows modules 12-16 to pivot about a vertical axis 134 which extends from bottom to top of each of the modules. By pivoting modules 12-16, merchandise items in the boxes may be easily replaced. Further, after rotating modules 12-16 and the merchandise items need to be replenished, inadvertent contact by the items being replenished with samples fastened to a front side wall on adjacent modules is prevented.

Referring to FIGS. 1 and 4, when the modules 12-16 are in their normal display position, preferably the plane of the back side wall 22a is coplanar with the front side wall 18b on adjacent module 14 to maximize floor space. Further, the back side wall 22b of module 14 is coplanar with the outer surface 66c of module 16. Although three modules are shown more or less modules can be added in a similar fashion to expand or reduce the amount of shelf and display space.

Preferably disposed on base 24 are stop blocks 140(a-c) and 142(a-c) constructed from a rigid material such as wood or plastic. Blocks 140 and 142 are positioned on base 24 to limit the pivot position of modules 12-16. Wooden stop blocks 140(a-c) limit the angle of rotation of the module about axis 134. Stop blocks 142(a-c) ensure that the module rotates back to its proper display position and then stops.

This concludes the description of the preferred embodiments. A reading by those skilled in the art will bring to mind various changes without departing from the spirit and scope of the invention. It is intended, however, that the invention only be limited by the following appended claims.

What is claimed is:

1. An apparatus for storing and displaying a plurality of different types of merchandise items comprising:

a plurality of juxtaposed modules each having vertically oriented and opposingly facing front and back side walls supporting a plurality of horizontally oriented shelves, said side walls having an opening therebetween on one end, and said shelves being vertically stacked between said side walls to form compartments between adjacent shelves with the inner surface of said side walls, said shelves being operative to support merchandise items received through the opening between the walls, and display panel means for supporting a merchandise sample of one of the merchandise items types horizontally adjacent one of said shelves where at least one of the same merchandise item types as the merchandise sample is to be stored.

2. The apparatus as recited in claim 1 further comprising a base disposed below said module means coupling said modules to said base for permitting said modules to pivot about a vertical axis extending through said module.

3. The apparatus as recited in claim 2 wherein said modules have a floor; and wherein said permitting means includes a plurality of substantially frictionless feet attached to a bottom surface of the floor to permit said module to slide along said base when pivoting.

4. The apparatus as recited in claim 2 further comprising a plurality of boxes with outer dimensions to substantially fill a compartment, said boxes having a partial opening at one end such that when said boxes are placed in said compartment merchandise may be removed from said box through said opening in said box and through said opening in the side walls.

5. The apparatus as recited in claim 1 further comprising a vertically oriented track guide extending along the outer surface of said front side walls; and a plurality of removable display panels held in place on the outer surface of said front side walls with said track guide.

6. The apparatus as recited in claim 5 further comprising means engaging with said side panels for supporting said merchandise samples.

7. The apparatus as recited in claim 1 further comprising a vertically oriented back wall extending perpendicular on one end of said back side walls and opposingly facing the opening.

8. The apparatus as recited in claim 7 wherein said front side walls of one of said modules in cross section extends partially along one module side, said partially extending side walls terminating in a connecting wall extending perpendicularly between said front side wall and the back side wall to form two chambers in said module.

9. The apparatus as recited in claim 1 wherein the side walls have a planar surface; and wherein the planes on the front side walls surface of said modules extend in parallel; and the back side wall of one of said modules is coplanar with the front side wall of an adjacent module.

10. The apparatus as recited in claim 1 further comprising a plurality of vertically oriented display panels extending along the outer surface of the front side wall; and a plurality of vertically oriented track guides attached to the outer surface of the front side wall having means for slidably receiving said plurality of display panels.

11. The apparatus as recited in claim 10 wherein a first of said track guides is positioned adjacent the front edge of said front side panel, a second of said track guides is positioned adjacent the rear edge of the front side panel and a third of said track guides is positioned between the first and second track guides.

12. A method for storing and displaying different types of merchandise items, the method comprising the steps of:

juxtaposing a plurality of modules with vertically oriented and opposingly facing front and back side walls;

supporting horizontally oriented shelves with the inner surface of the walls;

forming compartments within the modules by vertically stacking the shelves between the side walls;

providing an opening at one end of said front and back side walls;

placing merchandise items through the opening and onto one of said shelves such that each compartment contains the same type of merchandise item; and supporting a sample of a merchandise item type on an outer surface of said front side wall at a location horizontally adjacent one of said compartments with the same type of merchandise item.

13. The method as recited in claim 12 further comprising the steps of pivotally connecting each of said modules to a base disposed below said modules; and rotating one of said modules about a vertical axis extending through said module and said pivot connection to a receive orientation where the opening in the module faces away from an adjacent module.

14. The method as recited in claim 13 further comprising the steps of providing a box having walls with an outside dimension that extends outward to contact the inner side surface of the side walls of a compartment when said box is placed in a compartment of the module; placing the box through the opening in the module and into an opening of the compartment when said module is in the receive orientation; and rotating the module in the receive orientation back to its original orientation after receiving the box.

15. The method as recited in claim 14 further comprising the steps of providing a display panel on the box which aligns with the front edge of one of the shelves when the box is placed in a compartment; and providing an opening in the box above the box display panel in which merchandise items may be removed from the box.

16. The method as recited in claim 12 further comprising the steps of placing a removable display panel on the outside surface of the front side; and supporting the sample of the merchandise item on the display panel.

17. An apparatus for storing and displaying a multiplicity of different types of merchandise items, the apparatus comprising:

a plurality of juxtaposed modules, each module comprising:

(1) an opposingly facing front and rear side walls, (2) a rear wall perpendicularly connected between the side walls, (3) a bottom at a lower end of the walls, and (4) a top extending parallel to the bottom at an upper end of the walls;

a first plurality of shelves extending between the side walls of each module parallel to the top and bottom operative to hold merchandise items;

the front side wall of an intermediate of said plurality of modules extending partially along a front side of the intermediate module and terminating in a connecting wall that extends perpendicularly between said front side wall and said back side wall;

a first partially enclosed chamber within said intermediate module faced by connecting wall, said front wall and a portion of said back side wall;

a second partially enclosed chamber within said intermediate module faced by said connecting wall, said rear wall and another portion of said back wall;

a second plurality of shelves in said intermediate module extending between the connecting wall and the back wall;

each of said modules front side wall having first means for supporting a first sample of merchandise items adjacent one of said first plurality of shelves where a multiplicity of the same type of merchandise items as said first sample merchandise item is operative to be held; and said first side wall of said intermediate module having second means for supporting a second sample merchandise item adjacent one of said second plurality of shelves where a multiplicity of the same type of merchandise item as said second sample merchandise item is held.

18. The apparatus as recited in claim 17 wherein the surface of said back side wall of each of said modules is coplanar with the surface of said front side wall of an adjacent juxtaposed module.

19. The apparatus as recited in claim 17 further comprising a base member for supporting the modules; and means engaging with said base member and said bottom for permitting said modules to pivot about an axis extending through said module from said top to said bottom.

20. The apparatus as recited in claim 19 further comprising one or more of boxes supported on said shelves, each box having four connected sides disposed about the periphery of a floor that substantially covers a top surface of a shelf; and one of said sides partially extending upward to provide a space between the upwardly extending side and an adjacent shelf disposed above the shelf covered by the floor of the box.

21. The apparatus as recited in claim 17 wherein said first and second means includes a plurality of track guides extending along the front side wall from the top to the bottom; and wherein said module further comprises a plurality of vertically stacked display panels removably mating within the track guide on the surface of the front wall.

22. The apparatus as recited in claim 19 further comprising stop means disposed on the base member for limiting the distance said modules pivot about the axis.

* * * * *